US005612064A

United States Patent [19]

Kosman

[11] Patent Number: 5,612,064

[45] Date of Patent: Mar. 18, 1997

[54] APPARATUS FOR MANUFACTURING GREEN BRICKS FOR THE BRICK MANUFACTURING INDUSTRY

[75] Inventor: Wilhelmus J. M. Kosman, Groesbeek, Netherlands

[73] Assignee: Beheermaatschappij De Boer Nijmegen B.V., Netherlands

[21] Appl. No.: 433,811

[22] Filed: May 3, 1995

[30] Foreign Application Priority Data

May 6, 1994 [NL] Netherlands ..... 9400756

[51] Int. Cl.[6] ..... B28B 5/02; B28B 7/10

[52] U.S. Cl. ..... 425/255; 264/297.7; 264/297.9; 264/334; 425/186; 425/195; 425/220; 425/443; 425/444; 425/452

[58] Field of Search ..... 425/186, 195, 425/220, 255, 348 R, 350, 351, 360, 443, 444, 452; 264/297.6, 297.9, 334, 297.7

[56] References Cited

U.S. PATENT DOCUMENTS

| | | | |
|---|---|---|---|
| 83,010 | 10/1868 | Walrath et al. | 425/348 |
| 86,732 | 9/1869 | Clark | 425/348 |
| 1,876,864 | 9/1932 | Davis | 425/254 |
| 2,200,270 | 5/1940 | Flores | 425/299 |
| 2,713,709 | 7/1955 | Wright | 425/360 |
| 3,137,029 | 6/1964 | De Zolt | 425/360 |
| 3,176,372 | 4/1965 | Lang | 425/255 |
| 3,257,701 | 6/1966 | Lang | 425/452 |
| 3,724,988 | 4/1973 | Gouws | 425/348 |

FOREIGN PATENT DOCUMENTS

| | | |
|---|---|---|
| 7309933 | 1/1974 | Netherlands . |
| 8802568 | 5/1990 | Netherlands . |

OTHER PUBLICATIONS

Abstract of German No. 1 901 983, Mar. 3, 1960.

*Primary Examiner*—Jay H. Woo
*Assistant Examiner*—Joseph Leyson
*Attorney, Agent, or Firm*—Webb Ziesenheim Bruening Logsdon Orkin & Hanson, P.C.

[57] ABSTRACT

An apparatus for manufacturing green bricks for the brick manufacturing industry includes mould containers which are placed on a chain conveyor and which are provided with movable bottoms. The green bricks are released by displacing the bottom of the mould containers. According to the invention the mould containers are combined to a mould container part and coupled to a chain part connectable to the chain. During exchange of mould containers the chain part remains coupled to the chain conveyor while the mould container part can be rapidly uncoupled and exchanged.

2 Claims, 3 Drawing Sheets

APPARATUS FOR MANUFACTURING GREEN BRICKS FOR THE BRICK MANUFACTURING INDUSTRY

BACKGROUND OF THE INVENTION

1. Field of the Invention

The invention relates to an apparatus for manufacturing green bricks from clay for the brick manufacturing industry.

2. Description of the Prior Art

Such an apparatus is known from the Netherlands patent application no. 8802568. It is the object of the invention to provide means to cause displacement of the movable bottom.

In order to exchange the mould containers these must be uncoupled from the driving chain conveyor.

The uncoupling from and subsequent re-coupling to the chain conveyor is time-consuming and laborious.

The invention has for its object to provide a solution to this problem such that exchanging of mould containers can take place rapidly and without great effort.

SUMMARY OF THE INVENTION

An apparatus for manufacturing green bricks from clay comprising a circulating chain conveyor carrying mould containers provided with movable bottoms, a reservoir for clay arranged above the mould containers, means for carrying clay out of the reservoir into the mould containers, means for pressing and trimming clay in the mould containers, means for discharging green bricks released from the mould containers and means for supplying and placing take-off plates for the green bricks, wherein the mould containers are combined to a mould container part and are detachably coupled to a chain part connectable to the chain and wherein an ejector displacing the movable bottom is connected to the mould container part.

With the invention it is possible to leave the chain part coupled to the chain conveyor while the mould container part with the mould containers can be easily and quickly uncoupled from the chain part and exchanged.

The mould container part can be coupled to the chain part by means of bolts.

The invention is further elucidated with reference to the drawings.

DESCRIPTION OF THE PREFERRED EMBODIMENT

Figure 1:
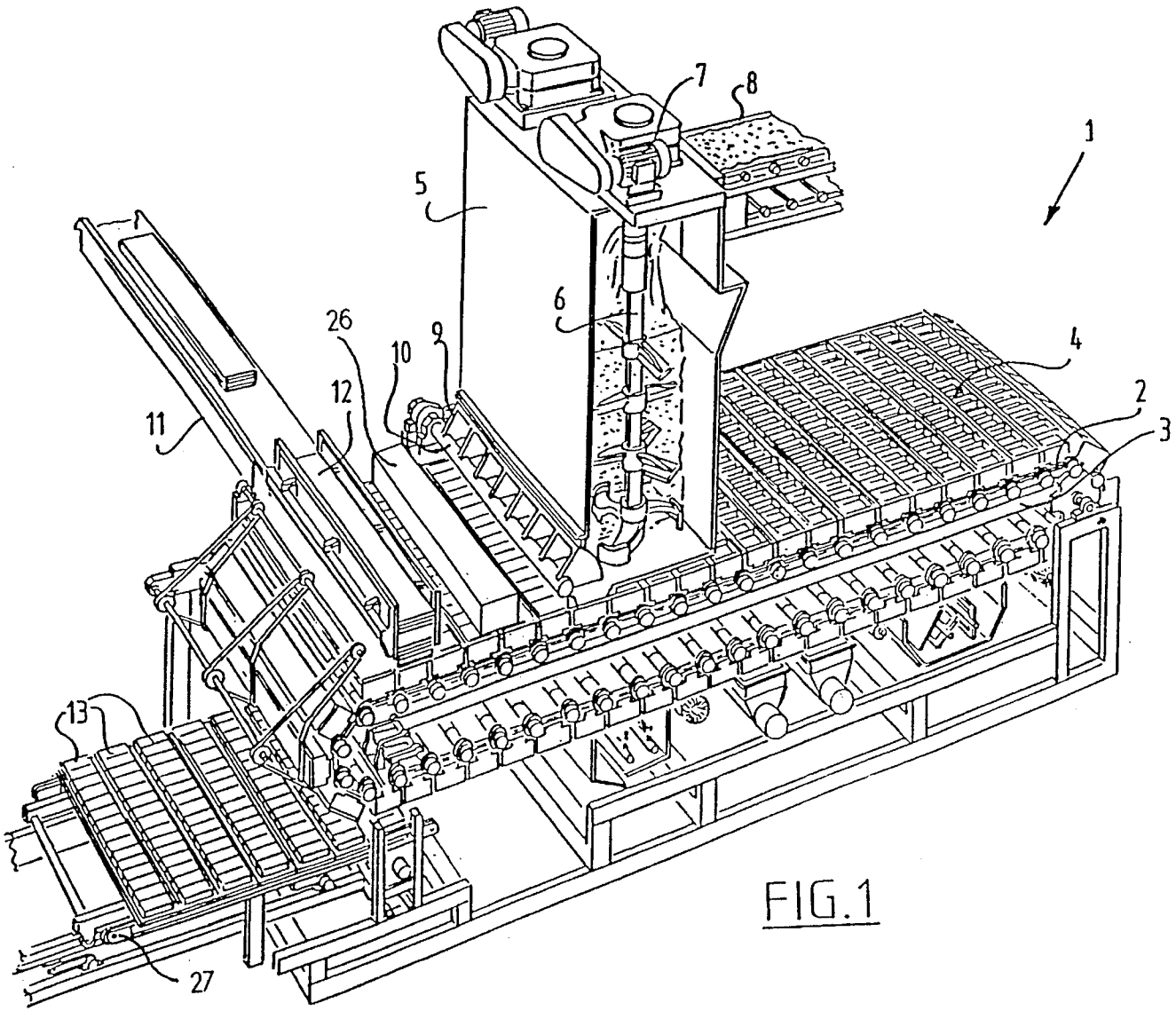
FIG. 1 shows a perspective view of the apparatus according to the invention.

The apparatus 1 for manufacturing green bricks for the brick manufacturing industry comprises a chain conveyor 3. Mould containers combined to a unit in the form of a mould container part 4 are placed on the chain conveyor. The mould container parts fit closely against each other. Placed above the mould containers is a reservoir 5 for clay which is kept in continuous movement by an agitator 6 which is driven by the electric motor 7. Clay is supplied to the reservoir 5 by a circulating conveyor 8. Clay is carried out of reservoir 5 into the mould containers and then pressed down by the pressing device 9 which is pivotable on the shaft 10. The excess clay is also trimmed using means 26. The device 11 carries take-off plates 12 onto a mould container part such that, after turning over of the mould container part, the green bricks 13 come to lie on the plates after being released from the mould containers and the plates with the released bricks thereon come to lie on discharge conveyor 27.

Figure 2:
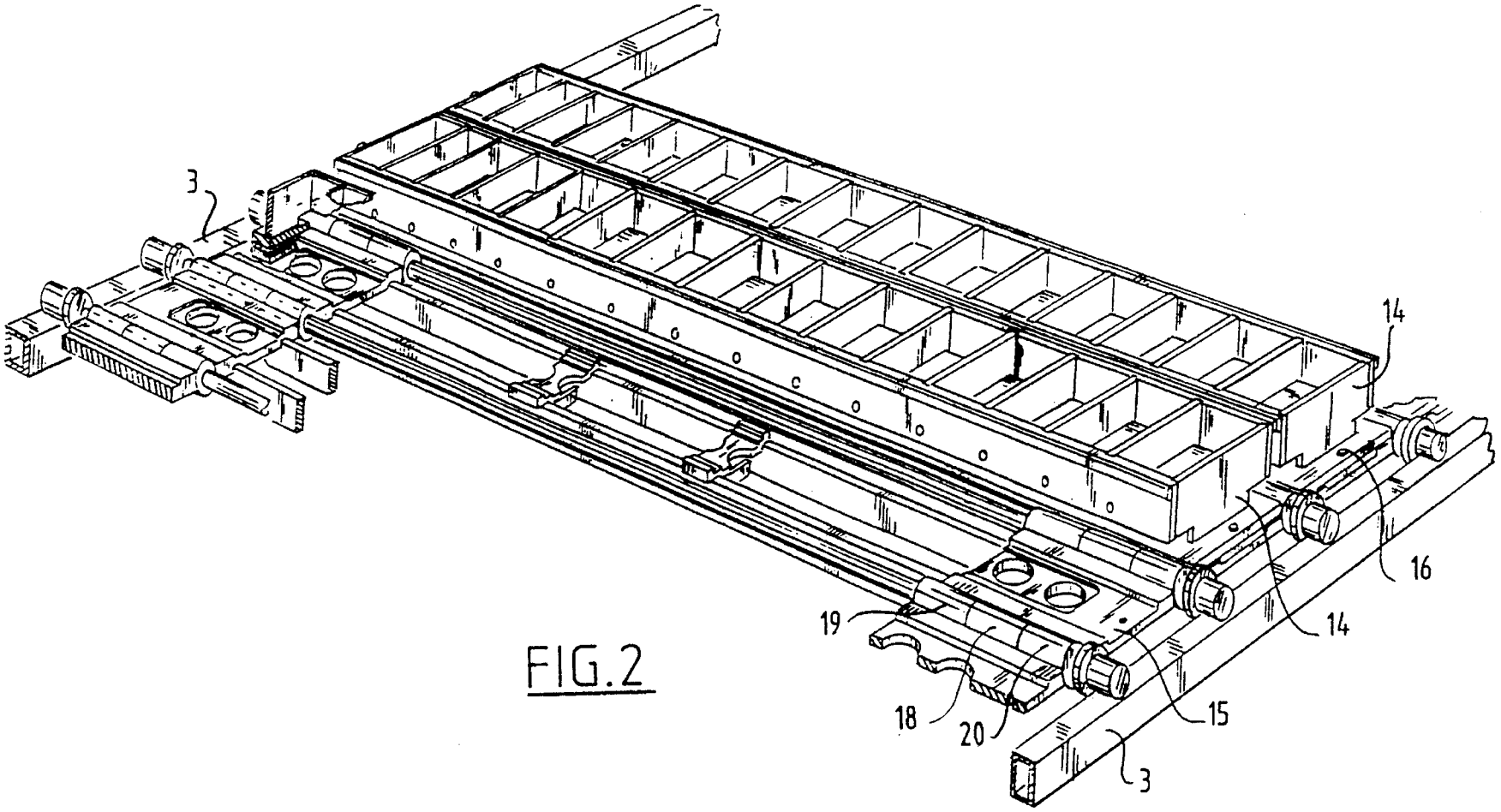
FIG. 2 is a perspective view of the mould container part and the chain part according to the invention in the coupled situation.
Figure 3:
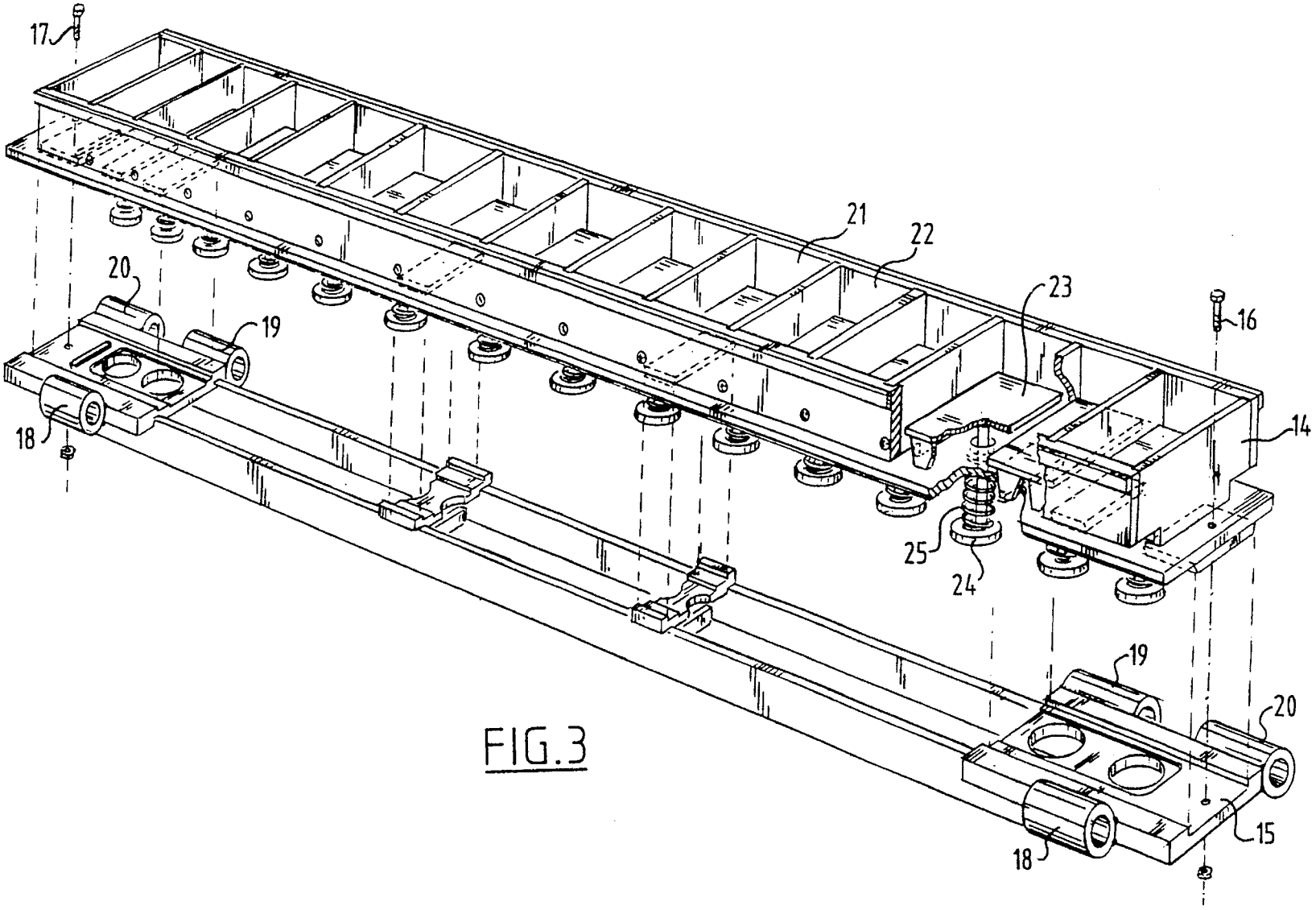
FIG. 3 shows the mould container part and the chain part according to the invention in uncoupled situation.

The mould container part 14 and the chain part 15 are mutually disengageable (FIGS. 2 and 3). The coupling of both parts takes place using the bolt-nut connections 16, 17 respectively. The chain part comprises ears 18, 19, 20 which serve as links of the chain conveyor. On the mould container part 14 the different mould containers, for instance 21, 22, are combined into a unit. The movable bottom 23 is driven according to the invention by the ejector 24. This lies under bias of the spring 25 which centres the ejector such that no separate guiding is necessary in the chain part 15. The ejector 24 is operated by a per se known driving device (not shown) during release of the green bricks.

In order to exchange the mould container parts it can suffice to unscrew the bolt-nut connections 16, 17, whereafter the mould container part can be detached from the chain part which remains connected to the chain conveyor. According to the invention the exchanging is less time-consuming not only because uncoupling from respectively recoupling to the chain conveyor can be omitted but also because the mould container part has a comparatively low weight.

In the case mould containers are used with different dimensions, the mechanism for ejecting the bottoms can be applied without modification.

I claim:

1. An apparatus for manufacturing green bricks from clay, comprising:

a circulating chain conveyor carrying mould containers provided with movable bottoms, a reservoir for clay arranged above the mould containers, means for carrying clay out of the reservoir into the mould containers, means for pressing and trimming clay in the mould containers, means for discharging green bricks released from the mould containers and means for supplying and placing take-off plates onto the mould containers after pressing and trimming the clay, wherein the chain conveyor turns over the mould container part such that green bricks are released from the mould containers and come to lie on the take-off plates and such that the take-off plates with the released bricks thereon come to lie on the discharging means, and wherein the mould containers are combined to a mould container part detachably coupled to a chain part connectable to the chain conveyor, and wherein an ejector is connected to the mould container part for displacing the movable bottom during release of the turned over green bricks from the mould containers, said ejector lying under bias of a spring serving as centering member for the ejector.

2. The apparatus as claimed in claim 1, wherein the mould container part is coupled to the chain part by means of bolts.

* * * * *